US005082283A

United States Patent [19]

Conley et al.

[11] Patent Number: 5,082,283

[45] Date of Patent: Jan. 21, 1992

[54] ELECTROMECHANICAL SWING TRAINER

[76] Inventors: William P. Conley, 2780 Packard, Ypsilanti, Mich. 48197; Anthony Foresi, 9717 Manor, Allen Park, Mich. 48101

[21] Appl. No.: 723,795

[22] Filed: Jul. 1, 1991

[51] Int. Cl.[5] ..... A63B 69/36

[52] U.S. Cl. ..... 273/186 A; 273/26 B

[58] Field of Search ..... 273/186 A, 26 B, 29 A, 273/186 R, 183 D

[56] References Cited

U.S. PATENT DOCUMENTS

| | | | |
|---|---|---|---|
| 3,215,437 | 11/1965 | Webb | 273/186 A |
| 3,806,131 | 4/1974 | Evans | 273/186 A |
| 4,515,368 | 5/1985 | Petitjean | 273/186 A |
| 4,789,160 | 12/1988 | Dollar et al. | 273/186 A |
| 4,852,875 | 8/1989 | McLennan | 273/186 A X |
| 4,969,921 | 11/1990 | Silvera | 273/186 A |

*Primary Examiner*—George J. Marlo
*Attorney, Agent, or Firm*—Krass & Young

[57] ABSTRACT

A golf swing trainer includes a sensor responsive to axial forces and a sensor responsive to lateral forces disposed in electrical communication with an alarm circuit. The training device is responsive to velocity and attitude of the golf club and is operative to provide a user-detectable signal if an improper swing is executed. An alarm is actuated when a predetermined lateral force is exceeded and a predetermined axial force is not exceeded.

20 Claims, 2 Drawing Sheets

ELECTROMECHANICAL SWING TRAINER

FIELD OF THE INVENTION

This invention relates generally to training devices and more specifically to swing training devices. Most specifically, the present invention relates to an electromechanical device for instructing a golfer in a proper swing.

BACKGROUND OF THE INVENTION

The game of golf, as well as various other physical activities, requires that a participant execute a precise set of physical maneuvers. Specifically, the game of golf requires that a player be capable of accurately swinging a club along a preferred path of travel within a proper range of velocity while simultaneously maintaining an appropriate orientation of the club. Clearly, there are many opportunities for error in the execution of a proper golf swing. Acquisition of an effective swing requires accurate neuromuscular programming and is typically achieved by repetition.

Many golfers employ the services of a professional trainer who observes and critiques their swing. Such services are expensive and are difficult to arrange at convenient times. Additionally, such critique generally provides a somewhat delayed feedback to the student. As a result of the foregoing, there has been a significant interest among golfers in the use of swing training devices. It is highly desirable that a swing training device provide an accurate and substantially instantaneous feedback to the user as to the qualities of his or her swing. It is further desirable that any such training device be usable in connection with fairly standard golfing equipment and that it be rugged, reliable and simple to use. Clearly, it is desirable that any swing training device accurately evaluate all parameters of a proper golf swing.

Heretofore, numerous devices have been developed to teach a proper golf swing. U.S. Pat. No. 4,854,585 of Koch discloses a golf club having a hinged shaft. The hinge is disposed and configured to stay rigid during a proper swing but to collapse during an improper swing. This training device requires a highly precise hinge capable of sustaining the high stresses encountered in the hitting of a golf ball. Consequently, it is expensive and difficult to manufacture and is subject to wear and failure.

Various electronic approaches have been implemented to assist in the training of golfers. U.S. Pat. No. 4,819,942 of Lee et al discloses a swing training device which mounts on the head of a golf club and includes an element responsive to centrifugal force. This trainer changes the balance of the club and does not provide any feedback with regard to club attitude and position. A similar approach is disclosed in U.S. Pat. No. 4,677,553 of Moore. Pat. No. 4,830,377 of Kobayashi discloses a golf club including a strain gage therein which senses swing speed by measuring the bend of the shaft. This club requires complex supporting electronics and does not teach proper swing form since it does not address questions of club attitude or position.

U.S. Pat. No. 4,789,160 of Dollar et al discloses a golf swing position sensor which is configured to mount onto the shaft of a golf club. The position sensor includes two mutually perpendicular sensors: a first senses the roll position of the striking surface of the golf club and the second the pitch position. While this device does measure club head position, it is not responsive to velocity of the swing and furthermore, it changes the balance of the club.

It is desirable to provide a golf swing sensor which measures the attitude, tempo, position and velocity of a golf club without materially affecting the golf club's balance, swing or appearance. It is further desirable that any such device be rugged, simple to use, and low in cost. The present invention provides for an improved golf swing training device which is totally self-contained and which is configured to fit into the handle of a conventional golf club. The sensor of the present invention provides for immediate and accurate feedback through all portions of the golf swing. These and other advantages of the present invention will be readily apparent from the drawings, discussion and description which follow.

BRIEF DESCRIPTION OF THE INVENTION

There is disclosed herein a swing training device which comprises an axial force sensor having a first set of electrical contacts and which is operative to change the state of the contacts when a predetermined axial force is exceeded. The device further includes a lateral force sensor which is operative to change the state of a second set of electrical contacts when a predetermined lateral force is exceeded. The device also includes an electrically actuated signalling device disposed in electrical communication with a source of electrical energy and the first and second sets of electrical contacts. In one particular embodiment, the axial force sensor includes a biasing element such as a spring or elastic member for maintaining the first pair of contacts in a closed position. In particular embodiments, a first pair of contacts includes a first shaft and a first contact block and the biasing element operates to maintain the shaft in contact with the block; this embodiment may further include at least one bearing element associated with the shaft disposed to allow for the axial displacement of the shaft.

In yet another embodiment of the present invention, the second pair of electrical contacts may include a second shaft and a pair of contact blocks. In this embodiment, the contact blocks are disposed in a plane and the shaft includes a bending element associated therewith for maintaining said element in a plane between the contact blocks when no lateral force is applied thereto. The training device may further include a cage member disposed to restrict the path of travel of the shaft associated with the lateral force sensor. The signalling device may be a sound generator or a light, or it may be a tactile signalling device such as a vibrator.

DETAILED DESCRIPTION OF THE DRAWINGS

Figure 1:
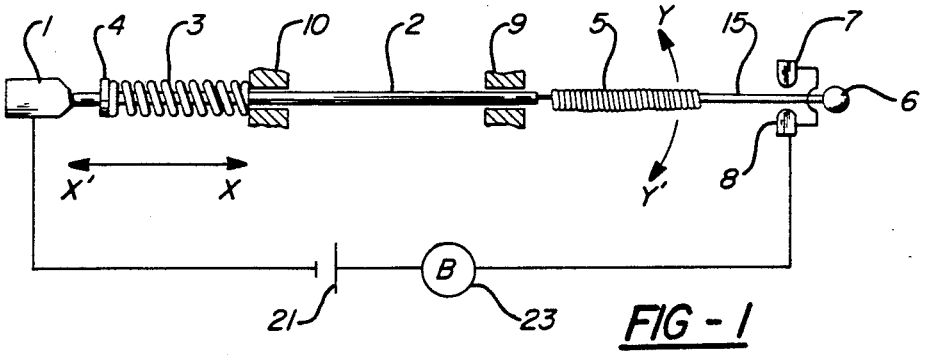
FIG. 1 is a top plan view of one embodiment of swing sensor structured in accord with the principles of the present invention.

Referring now to the drawings and, in particular, to FIG. 1, there is depicted a top plan view of an embodiment of the sensor elements of the swing training device of the present invention. The swing trainer includes an axial force sensor, a lateral force sensor and an associated signally device which cooperate to define a preselected path of travel.

Specifically, the axial force sensor element includes a first pair of electrical contacts comprising a contact block 1 and a shaft 2; a pair of bearing elements 9,10; a biasing element 3; and a stop 4. The lateral force sensor element includes a second set of electrical contacts including a contact block 7, a contact block 8, and a shaft 15; a lateral bending element 5; and a mass 6. All three contact blocks 1, 7 and 8 are connected to an electrical signaling device as discussed more fully herein in connection with FIG. 5.

Shaft 2 is supported by bearing elements 9 and 10 which allow it to slide in an axial direction along the X-X' axis as denoted in FIG. 1. A biasing element 3, such as a spring, is constrained between the bearing element 10 and the stop 4. Alternatively, the biasing element may comprise an elastic body such as a rubber band or the like. The biasing element 3 acts to maintain contact between the first end of shaft 2 and the contact block 1 with a predetermined force. In this embodiment, the mass 6 provides an axial force through elements 2, 5 and 15.

The second end of the axial sensor shaft 2 is connected to the first end of the lateral sensor shaft 15 by a spring 5 or an elastomeric body which functions as a bendable coupling and is operable to provide for lateral motion of the shaft 15 in the Y-Y' plane. The spring 5 also allows for electrical conduction between the two shafts 2 and 15.

A portion of the lateral sensor shaft 15 is suspended between the contact blocks 7 and 8. Referring to FIG. 1, it will be noted that contact blocks 7 and 8 are placed relative to shaft 15 in the direction labeled Y-Y', so that one contact block is on either side of shaft 15. A mass 6 is attached to the second end of shaft 15 such that a predetermined movement of mass 6 in a lateral direction along the Y-Y' axis will cause shaft 15 to touch either contact block 7 or 8.

The swing trainer of FIG. 1 further includes a battery 21 and a signalling device such as a sound generator 23, disposed in an electrical series relationship with one another and with the first contact 1, the axial sensor shaft 2, the lateral sensor shaft 15, and the second and third contact blocks 7 and 8. The circuit defined thereby operates to activate the sound generator 23 whenever the set of contacts defined by block 1 and shaft 2 as well as the set of contacts defined by shaft 15 and either of blocks 7 and 8 are closed.

While FIG. 1 illustrates one particular configuration of swing trainer, it is to be understood that other configurations will be readily apparent to those of skill in the art. For example, the sensors may comprise mechanically discrete, electrically interconnected sensors. The signalling device may comprise a light or a tactile signalling device such as a vibrator. Additionally, it is to be noted that while the foregoing illustrates a series electrical relationship for the sensors, battery and signalling device, parallel and mixed series/parallel arrangements may be similarly employed.

Figure 2:
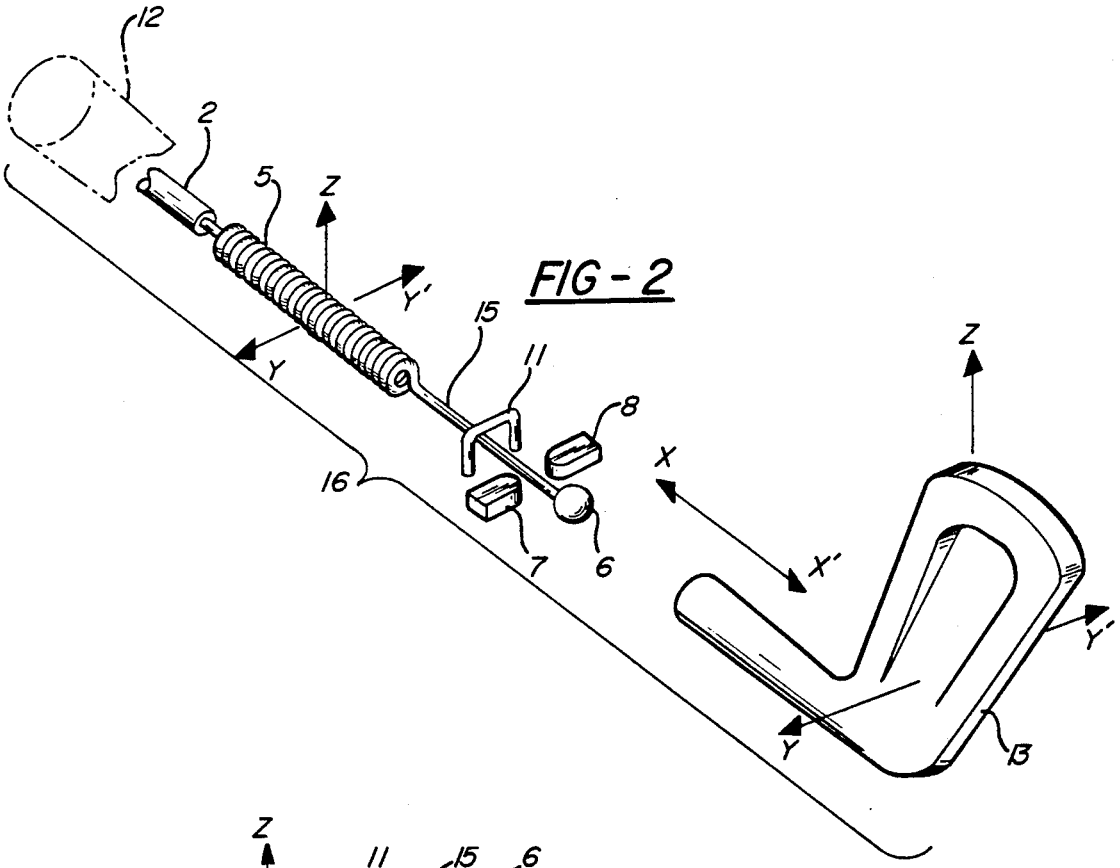
FIG. 2 is a perspective view of a portion of a golf club cut away to show the lateral force sensor element of the swing trainer of the present invention.

FIG. 2 provides a perspective view of the lateral force sensor portion of applicant's invention positioned within the grip 12 of a standard golf club and its resultant orientation with respect to the club head 13. As shown in FIG. 2, shaft 15 (as well as shaft 2 shown in conjunction with shaft 15 in FIG. 1) is oriented along the length of the club grip 12 and optionally along a portion of the club shaft 16 in the X-X' direction. The placement of contact blocks 7 and 8 relative to shaft 15 corresponds to the Y-Y' axis shown on club head 13 shown in FIG. 2. Thus, mass 6 is positioned to react to forces along the Y-Y' axis and the axial force sensor is positioned to react to centrifugal forces generated in the X-X' axis of the club shaft 16.

Figure 5:
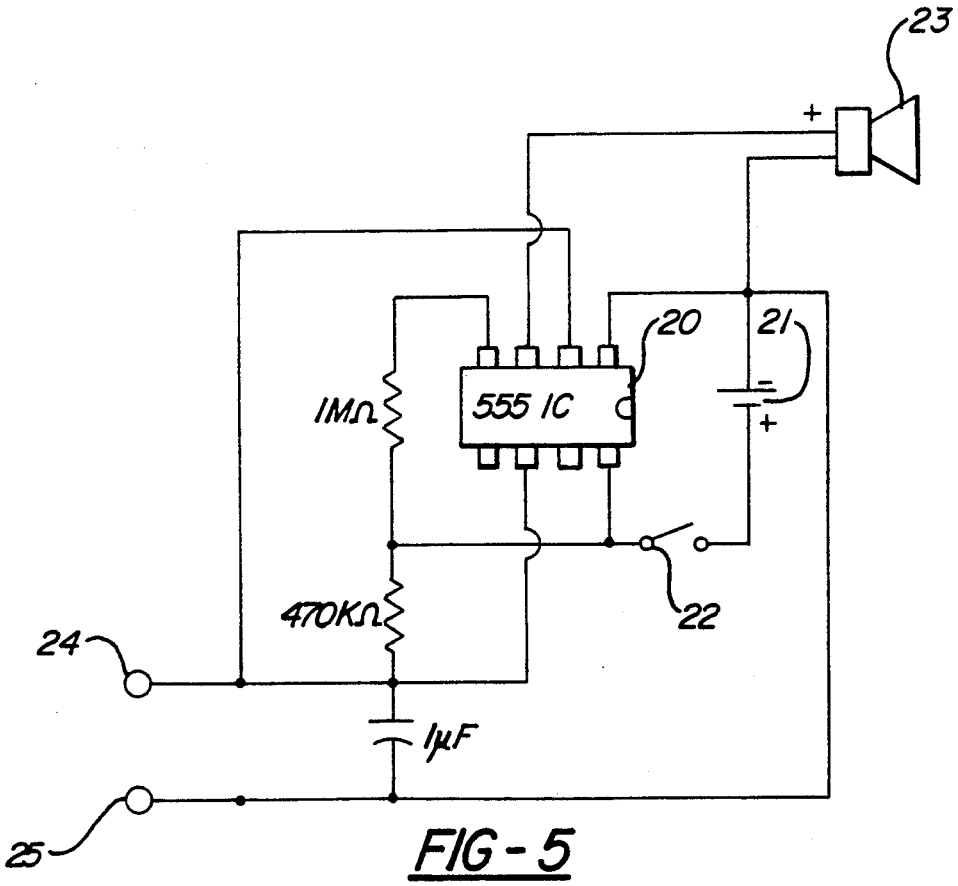
FIG. 5 is a schematic diagram of one particular embodiment of electronic circuitry which may be used in connection with the sensor of the present invention.

FIG. 5 shows a schematic diagram of a typical signaling circuit that works in conjunction with the axial force sensor and the lateral force sensor of the swing training device to alert the user when an improper swing has been executed. The circuit is designed to provide a sustained electrical signal of predetermined duration upon momentary completion of the circuit, for actuation of the signalling device.

As shown in FIG. 5, the circuit includes an integrated timer 20, a source of electrical energy 21, a master power switch 22, an electrically actuated sound generator 23, and a pair of terminals 24 and 25. In the preferred embodiment, the source of electrical energy 21 is a battery and the integrated timer 20 is of a type commonly designated as a "555 IC" and which is available from a number of manufacturers. One source of the timer is the Texas Instruments Corporation. Terminals 24 and 25 are connected to contact blocks 1, 7 and 8. For example, terminal 25 could be connected to contact block 1 and terminal 24 could be connected to contact blocks 7 and 8, it being understood that the opposite polarity could be employed with equal advantage.

The master power switch 22 is preferably mounted in the area of the club grip 12 for easy reach during normal use of the club. The master power switch 22 could be a momentary contact switch, activated only when the user's hands are in correct position on the club grip 12, or a toggle type switch that stays in either the "on",or "off" position.

The electrically actuated sound generator 23 emits an audible sound when the master power switch 22 is activated and the circuit is completed. The intent of the sound generator 23 is to alert the user when a swing error is detected. Thus, the sound generator 23 could be replaced with a visible light or a tactile signal generator such as a vibrating device consisting of a motor with eccentric weight or a vibrating solenoid mounted in the grip area of the club and the same objective would be achieved.

When positioned within the grip 12 of a standard golf club, the swing training device is triggered at various phases of the golf stroke if the swing is improper. For example, during the takeaway phase, the club is moved in the Y-Y' direction. At this point in the swing, no significant centrifugal force exists along the X-X' axis of the club shaft 16, so the elements of the axial force sensor are not separated, i.e., shaft 2 is biased against contact block 1 by the spring 3. If the motion of the swing during the takeaway phase is too sudden or jerky, the lateral force sensor will be activated: the mass 6 will shift in response to the sudden or jerky motion, thus causing shaft 15 to touch either contact block 7 or 8. When shaft 15 touches either contact block 7 or 8, current flows from contact block 1 to complete the circuit, thus causing the electrically actuated sound generator 23 to emit noise, such as a beep. The sound of the beep indicates to the golfer an error in the tempo of the swing during the takeaway phase.

The swing training device also provides audible feedback to the golfer during the backswing phase of the golf stroke. During the backswing, the toe of the club head 13 leads the direction of the swing (shown as the Z direction in FIG. 2). Thus a force only acts in the Z direction during a proper swing. Any change in the angle of the club head 13 relative to the plane of swing will cause a component of force to move mass 6 toward either contact block 7 or 8. Again, without the presence of any significant centrifugal forces during this phase of the swing to separate contact block 1 and shaft 2 of the axial force sensor, the circuit will be completed and the sound generator 23 will be activated if the movement of mass 6 is sufficient to cause shaft 15 to connect with either contact block 7 or 8. This indicates either an error in the angle of the club head 13 or in the plane of the club shaft 16 during the early phase of the backswing.

Figure 3:
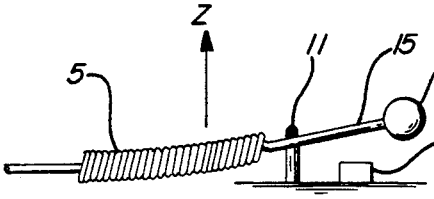
FIG. 3 is a side elevational view of the lateral force sensor of FIG. 2 depicting the action of a force in the Z direction thereupon.

Errors in other phases of the backswing may also be detected by the swing trainer of the present invention. As shown in FIGS. 2 and 3, a restraining cage member 11 straddles the portion of shaft 15 located between the lateral bending element 5 and the contact blocks 7 and 8. At the top of the backswing, the club shaft 16 decelerates smoothly to a roughly horizontal position with the toe of the club head 13 pointing downward at an angle between 45 degrees and 90 degrees. At this point, gravity exerts a force which moves mass 6, and consequently shaft 15, in the Z direction outside of the region between contact blocks 7 and 8. When this occurs, the restraining cage member 11 provides a stop to counter the force of gravity and to prevent shaft 15 from moving beyond a predetermined position. FIG. 3 best illustrates the function of the restraining cage 11 when shaft 15 is outside the region between contact blocks 7 and 8. A jerky deceleration in the backswing or a gross error in the position of the club head 13 at the top of the backswing will cause shaft 15 to connect with either contact block 7 or 8, thus closing the circuit and activating the sound generator 23.

During the downswing, force continues to act in the Z direction shown in FIGS. 2 and 3. Any sudden change in the swing plane or in the angle of the club head 13 early in the downswing will activate the sound generator 23 by causing shaft 15 to connect with either contact block 7 or 8. As the downswing continues, centrifugal force continues to build to the point where shaft 2 and contact block 1 of the axial force sensor separate and disable the circuit. At this point, the club is committed to a path and is travelling at a sufficient speed so the audible signal of the swing training device is no longer needed. However, if the downswing does not attain enough speed to generate the centrifugal force necessary to separate and deactivate the axial force sensor, natural wrist rotation will act to move mass 6 and shaft 15 toward either contact block 7 or 8, thus activating the sound generator 23. This tells the golfer that insufficient speed is being developed on the downswing.

In a proper swing, as the club moves toward the follow through phase, centrifugal force decreases and shaft 2 of the axial force sensor is reconnected with contact block 1. A proper follow through motion requires smooth deceleration of the club with the toe pointing roughly in the plane of swing. Thus, during a proper follow through, only forces in the Z direction act on mass 6 and the sound generator 23 will not be activated. (See FIG. 3.) However, if the follow through is abbreviated or the angle of the club head 13 is changed, forces will act in the Y-Y′ direction and mass 6 will cause shaft 15 to move toward either contact block 7 or 8. If this occurs, the circuit will be completed since the contact block 1 and shaft 2 of the axial force sensor are in contact at this point in the swing. When the sound generator 23 is activated, this indicates to the golfer an error in the tempo of the swing or in club position in the follow through phase.

Figure 4:
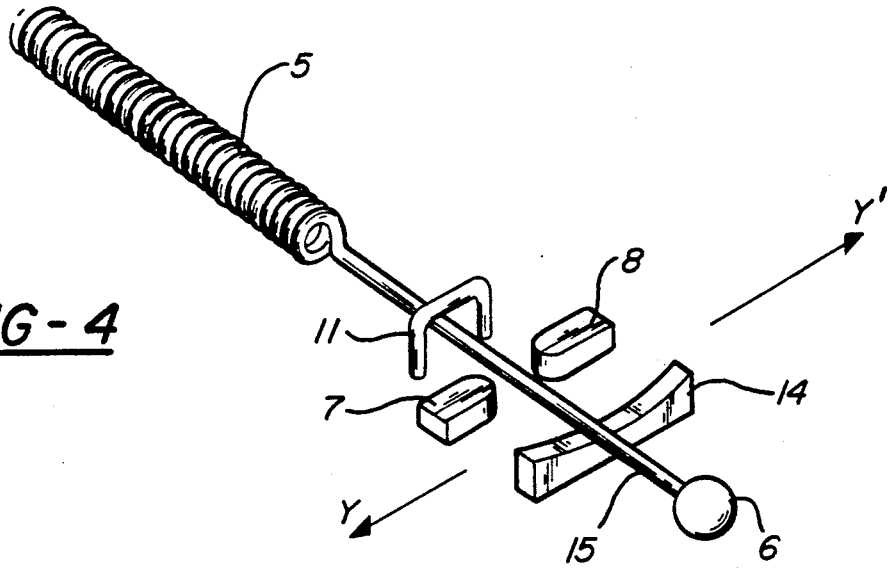
FIG. 4 is a perspective view of yet another embodiment of lateral force sensor structured in accord with the principles of the present invention.

Adjustability of the axial force sensor may be accomplished by varying the axial stiffness of the biasing element 3 to change the sensor's sensitivity to centrifugal forces. Likewise, the stiffness of lateral bending element 5 can be changed to adjust the sensitivity of the lateral force sensor to the position of the club head 13 on the tempo of the swing. FIG. 4 illustrates how an additional element, a contoured track 14, may be added to the lateral force sensor for adjustment purposes. Track element 14 can be placed such that shaft 15 rests against it. Thus it is possible to independently adjust the sensitivity of mass 6 to movement along the Y Y′ axis based on the shape of contoured track 14. The contoured track 14 may also be flexible in nature to allow for custom-tuning of the swing training device to an individual golfer's swing habits.

Applicant's entire swing training device, including the signaling circuit and source of electrical energy 21, is preferably mounted within the swinging instrument in the area of the grip. This feature, along with the compact sensing device, makes for a training club that is almost indistinguishable from a standard club.

While the foregoing discussion was primarily concerned with golf clubs, it will be appreciated that the principles of the present invention may be adapted to any implement which is swung along a preferred path of travel in use. Toward that end, the present invention may be utilized in connection with bats, racquets, flyrods and the like. Having thus described my invention, it can be seen that numerous alternative configurations can be envisioned by one skilled in the art by utilizing the teachings of this invention. It is the claims and all equivalents thereof, not the embodiments and exemplifications described herein, which define the true scope of the invention.

I therefore claim:

1. A swing training device comprising:

an axial force sensor including a first set of electrical contacts, said axial sensor operative to change the state of said first set of contacts when a predetermined axial force is exceeded;

a lateral force sensor including a second set of electrical contacts, said lateral sensor operative to change the state of said second set of contacts when a predetermined lateral force is exceeded;

an electrically actuated signalling device; and a source of electrical energy disposed in electrical communication with said signalling device, said first set of contacts and said second set of contacts, and means for actuating said signalling device when said predetermined lateral force is exceeded and said predetermined axial force is not exceeded.

2. A swing training device as in claim 1, wherein said axial force sensor further includes a biasing element operable to exert an axial biasing force which maintains said first set of electrical contacts in a first state in the absence of said predetermined axial force.

3. A swing training device as in claim 2, wherein said biasing element comprises a spring.

4. A swing training device as in claim 2, wherein one member of said first set of electrical contacts is mechanically coupled to a mass, said mass operable in response to said axial force to overcome said biasing force so as to change said first set of contacts to a second state.

5. A swing training device as in claim 4, wherein the first state of said first set of contacts is a closed state and the second state of said first set of contacts is an open state.

6. A swing trainer as in claim 2, wherein said lateral force sensor further includes a lateral biasing element operable to exert a lateral biasing force which maintains said second set of electrical contacts in a first state in the absence of said predetermined lateral force.

7. A swing training device as in claim 2, wherein said first set of electrical contacts includes a first shaft and a first contact block and said biasing element is operative to urge the shaft into contact with the contact block.

8. A swing training device as in claim 7, further including a bearing element associated with said shaft and operative to allow for axial displacement of said shaft.

9. A swing training device as in claim 7, wherein said second set of contacts includes a second shaft and a second contact block.

10. A swing training device as in claim 9, wherein said second set of contacts includes a third contact block and said second shaft and second contact block are disposed in a plane so that the second shaft is in an open position between said second and third contact blocks when no lateral force is applied to said lateral force sensor.

11. A swing training device as in claim 10 wherein said second shaft has a lateral bending element associated therewith, said bending element operative to bias said second shaft to said open position in the absence of said lateral force.

12. A swing training device as in claim 11 further including a cage member disposed to restrict the path of travel of said second shaft.

13. A swing training device as in claim 11 further including a track member disposed to engage said second shaft and to support said shaft for lateral motion therealong.

14. A swing training device as in claim 11, wherein said support board is configured to be fitted into the handle of a golf club.

15. A swing training device as in claim 1, wherein said second set of contacts is mechanically coupled to a mass which is operable, in response to said lateral force to overcome said lateral biasing force so as to change said second set of contacts to a second state.

16. A swing trainer as in claim 1, wherein at least one member of said first set of contacts and at least one member of said second set of contacts are mechanically coupled to a single mass, said mass operatively disposed to provide said axial force and said lateral force in response to motion of said training device.

17. A swing training device as in claim 1, further including an on/off switch disposed in series with said source of electrical energy.

18. A swing training device as in claim 1, further including a support board for retaining said sensors, signalling device and source of electrical energy.

19. A swing training device as in claim 1, wherein said signalling device is selected from the group consisting of sound generators, lights, and tactile generators.

20. A golf swing training device comprising:

I. an axial force sensor, said sensor including:
- a first, generally elongated shaft;
- a support bearing disposed to retain said first shaft and to allow for the lengthwise displacement thereof;
- a first contact block; and
- a spring disposed to bias a first end of said first shaft into contact with said first contact block;

II. a lateral force sensor including
- a second, generally elongated shaft aligned along a common linear axis with said first shaft;
- a spring member disposed to interconnect a first end of said first shaft to a first end of said second shaft;
- a second and third contact block disposed on opposite sides of said second shaft proximate a second end thereof;
- a weight disposed on the second end of the second shaft;

III. a signalling circuit disposed in a series electric relationship with said first contact block, said first shaft, said spring, said second shaft and said second and third contact blocks, said signalling circuit including a source of electrical power and a signalling device and means for actuating said signalling device when said predetermined lateral force is exceeded and said predetermined axial force is not exceeded.

* * * * *